US006206184B1

(12) United States Patent
Goguen et al.

(10) Patent No.: US 6,206,184 B1
(45) Date of Patent: Mar. 27, 2001

(54) MULTIMEDIA DISTRIBUTION PACKAGE

(75) Inventors: George J. Goguen, Warren, VT (US); Jonathan Daniel McVey, Portland, OR (US)

(73) Assignee: Saga Software, Inc., Reston, VA (US)

( * ) Notice: Subject to any disclaimer, the term of this patent is extended or adjusted under 35 U.S.C. 154(b) by 0 days.

(21) Appl. No.: 09/479,898

(22) Filed: Jan. 10, 2000

(51) Int. Cl.[7] ..... B65D 69/00
(52) U.S. Cl. ..... 206/232; 206/805
(58) Field of Search ..... 206/232, 805, 206/583, 594, 308.1, 308.3

(56) References Cited

U.S. PATENT DOCUMENTS 1,842,034 * 1/1932 Lewis ..... 206/583
3,561,595 * 2/1971 Weggeland ..... 206/805
3,823,814 * 7/1974 Lum ..... 206/232
3,970,129 * 7/1976 Tepfer ..... 206/805

* cited by examiner

*Primary Examiner*—M. D. Patterson
*Assistant Examiner*—Shian Luong
(74) *Attorney, Agent, or Firm*—Venable; James R. Burdett

(57) ABSTRACT

A multimedia distribution box includes a container portion and a lid portion. The container portion includes a plurality of upstanding walls, at least two of which are opposing, and a pair of slots, each of which is formed in a respective one of the opposing walls. It is used to contain computer software and documentation associated with the software. The lid portion is adapted to cover the container portion, and thereby enclose the software and the documentation within the assembled box. An insert is provided for selectively positioning the software within the container portion, and a band is used to maintain the insert, the software, and the documentation firmly in place.

20 Claims, 15 Drawing Sheets

MULTIMEDIA DISTRIBUTION PACKAGE

BACKGROUND OF THE INVENTION

1. Field of the Invention

The present invention relates generally to packaging for computer software, and more particularly packaging that is adaptable for shipping and displaying computer software and its associated documentation.

2. Statement of the Prior Art

Various means and methods for securely shipping and displaying computer software have been proposed in the past. For example, U.S. Pat. No. 4,287,989 (Plummer) discloses a form of the classic storage container for magnetic tape cassettes of the type used in home and auto stereos. The storage container contains one or more protuberances, which are capable of being located in association with the capstan locating holes of the cassette to fixedly maintain the cassette within the storage container. Similar containers have also been used for computer software stored in magnetic tape.

The classic form of a "jewel box" for optical disks or CD-ROMs is, likewise, disclosed in U.S. Pat. No. 4,771,890 (Hofland et al.) According to that patent, a retainer for holding and protecting an optical disk is molded from plastic, to form a thin, flat, rectangular base member having a shallow rectangular cavity in the front surface thereof. A shallow circular cavity is centrally located within the rectangular cavity. The disk is resiliently held within the circular cavity, and can be removed by finger lifting. The retainer's top edge includes a hook recessed into its flat top edge. This hook allows the retainer to be vertically hung from, and perpendicular to, a horizontal storage rod. The retainer includes short, spaced posts located within the top portion of the rectangular cavity. A flat storage envelope mounts on these posts, to overlay the disk's exposed surface. The two external, vertically extending side walls of the base each include a flat, protruding, label surface located at the center of the side wall. Two flat box shaped containers are provided. One container holds a single retainer. Another container holds two disk retainers, or in the alternative a single retainer, a dummy retainer and relatively thick material auxiliary to use of the disk. When a retainer is mounted in a container, its hook is concealed, but the retainer's label surfaces protrude through openings provided in the container.

Other prior art providing packages for storing and protecting software in the form of flat, disk-shaped objects are disclosed in U.S. Pat. No. 2,663,416 and U.S. Pat. No. 3,825,112.

One problem with the above packaging is that it does not accommodate media of differing sizes and shapes. For example, computer software for complex enterprise resource planning (ERP) and middleware used with such software often requires voluminous documentation to describe the setup and operation of such computer software. Moreover, such computer software is likely to be distributed in multiple formats, such as magnetic tape (DAT, IBM 3270 format, etc.), CD-ROM, and diskettes, whether of the standard, 1.44 megabyte format, ZIP® or JAZ® (both of which are registered trademarks of Iomega Corporation) formats. It would, therefore, be desirable to provide packaging adaptable for shipping and displaying computer software, its associated documentation, and other media of differing sizes and shapes.

For example, U.S. Pat. No. 5,251,749 (Knight) discloses an interlocking storage system for different types of electronic or magnetic recording media, including compact discs and cassette tapes. A standard size module is provided which can accommodate and store one standard dual compact disc box and one single compact disc box, three single compact disc boxes or two standard audio cassette boxes. Alternatively, other selected electronic recording media may be stored. The user selects releasable left and right side elements which securely compartmentalize the selected recording media within the module. This module provides both a horizontal and vertical interlocking means so that users may utilize numerous modules which are interconnected in both the vertical and horizontal direction to form a free-standing modular cabinet or storage system for their home entertainment collection.

U.S. Pat. No. 5,651,456 (Gunning) discloses a multimedia storage container assembled from electrically non-conducting materials and including an elongated rectilinear outer sleeve, or case, that defines a cavity in which a partitionable insert, or drawer, resides to receive and securely store different types and sizes of computer data media in a dust-free, static-free environment. A plurality of columnar supports are located within the cavity and adjacent side panels to enhance the structural rigidity of the outer sleeve. The columnar supports extend through the outer sleeve to enable interconnection of the columnar supports of a first outer sleeve to those of, at least, a second outer sleeve, thereby enabling the creation of virtually continuous column supports to enhance the stackability of storage containers. A base plate rests in the bottom of the cavity adjacent to a bottom panel of the outer sleeve and releasably latches to each columnar support to structurally unite the columnar supports and provide increased structural strength. The multi-media storage container further includes a face plate coupled to the insert to function as a front for the outer sleeve, while providing a user with a means for inserting or removing the insert from the cavity.

A multi-media librarial storage system including a plurality of individual book-like storage containers is described. Each individual book-like storage container within the system is adapted to receive a plurality of interchangeable receiver inserts configured and dimensioned to retain a variety of multi-media cassette packages such as the common Philips audio cassette, video tape packages of the familiar VHS, VHS-C/8 mm video cassettes, digital audio tape (DAT) cassettes, CD-ROMs, computer software diskettes, and other related multi-media items. The receiver inserts disposed within the storage containers are fabricated from sheets of foldable materials such as paperboard using cut and fold techniques common to the packaging industry. Interchangeability among a plurality of differently configured and dimensioned receiver inserts is achieved by the use of integral locking tabs formed on the receiver inserts which are installed within mating slots formed within the individual storage containers. Detachable fastening means are interposed between the interchangeable receiver inserts and the interior surfaces of the storage containers to secure the same in their functional position. The multi-media librarial storage system is provided with alpha/numeric labels which are applied to the book-like spine of the storage containers to identify items stored therein and to facilitate retrieval. The multi-media librarial storage system is provided with a companion index volume wherein the user may identify and catalog items stored within the system by the identification labels.

Although the prior art includes various types of containers for the storage of audio or video cassettes, there is a need for a librarial storage system for storing, identifying and organizing the proliferation of audio and video cassette tapes, computer diskettes, CD-ROMS and other related items having different configurations within a storage system that is uniform in appearance and function. Thus, the present invention has been developed to provide a multi-media librarial storage system to solve this problem and other shortcomings of the prior art.

SUMMARY OF THE INVENTION

Accordingly, it is a general object of the present invention to provide a packaging that is adaptable for shipping and displaying computer software, its associated documentation, and any other training materials related to such software.

A more specific object of the present invention is to provide a box for shipping computer software in the form of a plurality of different kinds of media, such as magnetic tape, magnetic disks, compact disks, and video tape.

Another object of the present invention is to provide a multimedia distribution box that is capable of shipping and displaying varying amounts of computer software, documentation, and other training materials.

The above and other objects are achieved by a multimedia distribution box that generally comprises a container portion and a lid portion. The container portion includes a plurality of upstanding walls, at least two of which are opposing, and a pair of slots, each of which is formed in a respective one of the opposing walls. It is used to contain computer software and documentation associated with the software. The lid portion is adapted to cover the container portion, and thereby enclose the software and the documentation within the assembled box. Insert means is provided for selectively positioning the software within the container portion, and restraint means is provided for maintaining the insert means, the software, and the documentation firmly in place.

Each of the slots are substantially rectilinear, although they may be tapered. The restraint means generally comprises a belt or band, which may be adjustable or continuous. According to a first embodiment of the present invention, the restraint means comprises a continuous plastic band that is looped around the container portion and within the slots. The restraint means, alternatively, may comprise an adjustable plastic band that is looped around the container portion and within the slots, according to a second embodiment. In yet a third embodiment, the restraint means comprises a flexible band that is adapted to provide a substantially uniform amount of pressure to restrain the insert means, the software, and the documentation throughout the length of the slots. That is, such a restraint means is adjustable to accommodate a variable amount of software, documentation, and other training materials. This is accomplished in the following manner.

First, the container has four generally upstanding walls including a front wall, a back Wall, and two side walls. It also includes a rim that extends around the tops of the upstanding walls, and a bottom. The slots are formed in respective ones of the side walls. Thereafter, the documentation and other training materials are placed within the container, and the software is placed on top of the documentation and other training materials within an insert that is adapted to position the software appropriately and securely within the container. At a minimum, the assembled software and insert, documentation, and other training material rises above the bottom of the container to a height that corresponds to the bottom of each slot. The band is then wrapped around the container, within the slots, to secure the software, documentation, and other training materials in place.

Because the walls of the container continue to extend above the bottom of the slots, it can be readily appreciated that additional inserts with corresponding software of the same or different media can be placed in the container. The slots permit this arrangement, yet facilitate this secure method of holding the software, documentation, and other training materials in place.

According to one important aspect of the invention, the insert comprises a shape extending the entire length of the container between the front wall and the back wall. This further promotes the security of the media comprising the software, documentation, and other training materials. In a presently preferred embodiment, the shape comprises a parallelogram, including a front portion that extends from a first corner of the container formed by the front wall and one of the side walls to a first point along the front wall, a back portion that extends from a second corner of the container formed by the back wall and the other of the side walls to a second point along the back wall, a first side portion that extends between the first corner to the second point, and a second side portion that extends between the second corner and the first point. In that manner, the software, documentation, and other training materials can not only be lodged between the front wall and back wall of the container, but also restrained from lateral movement by virtue of its being kept between diagonal corners of the container.

Other objects, advantages, and novel features of the multimedia distribution box according to the present invention will become more apparent from the following detailed description thereof, in conjunction with the following drawings wherein:

DETAILED DESCRIPTION OF THE PREFERRED EMBODIMENT

Figure 1:
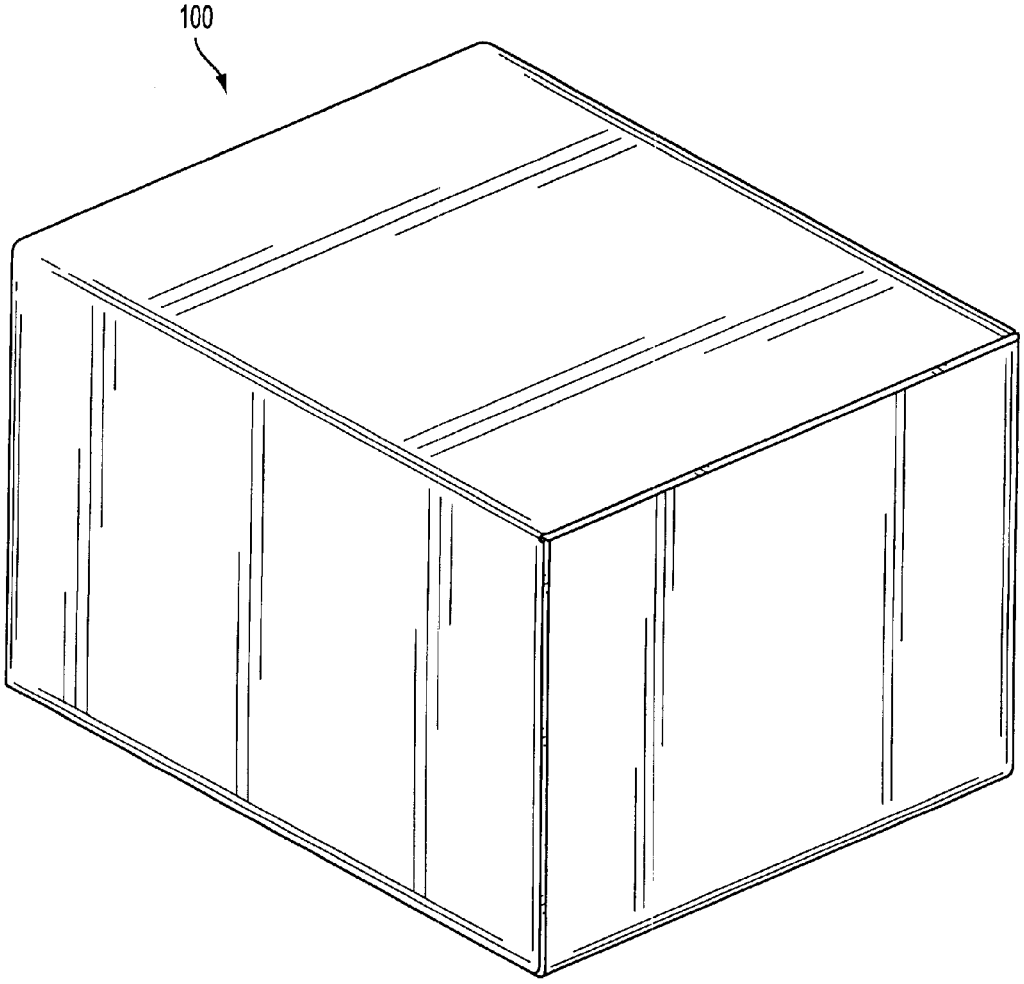
FIG. 1 is an outside view, shown in perspective, of a multimedia distribution package according to the present invention.
Figure 2:
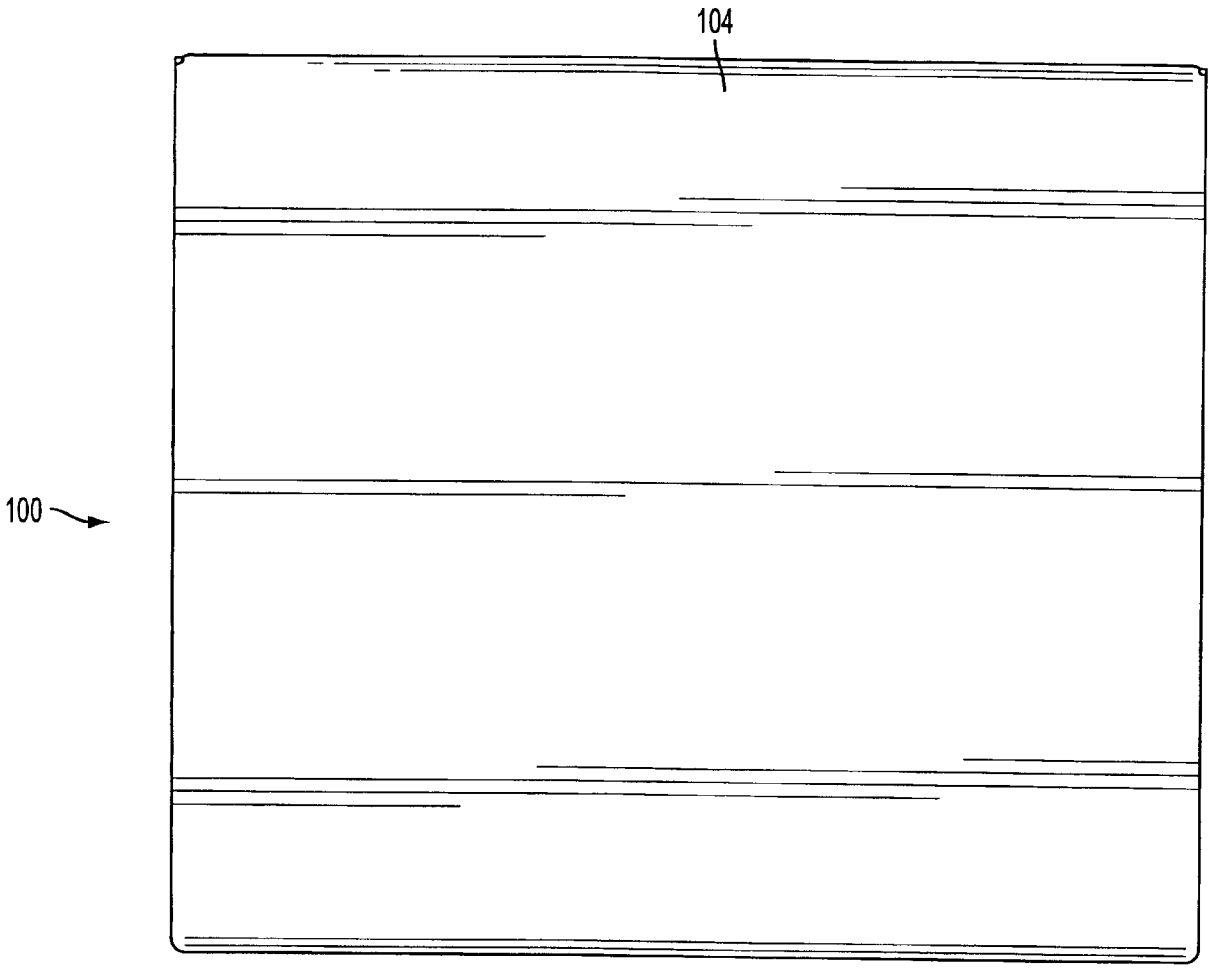
FIG. 2 is a top plan view of the multimedia distribution package shown in FIG. 1.
Figure 3:
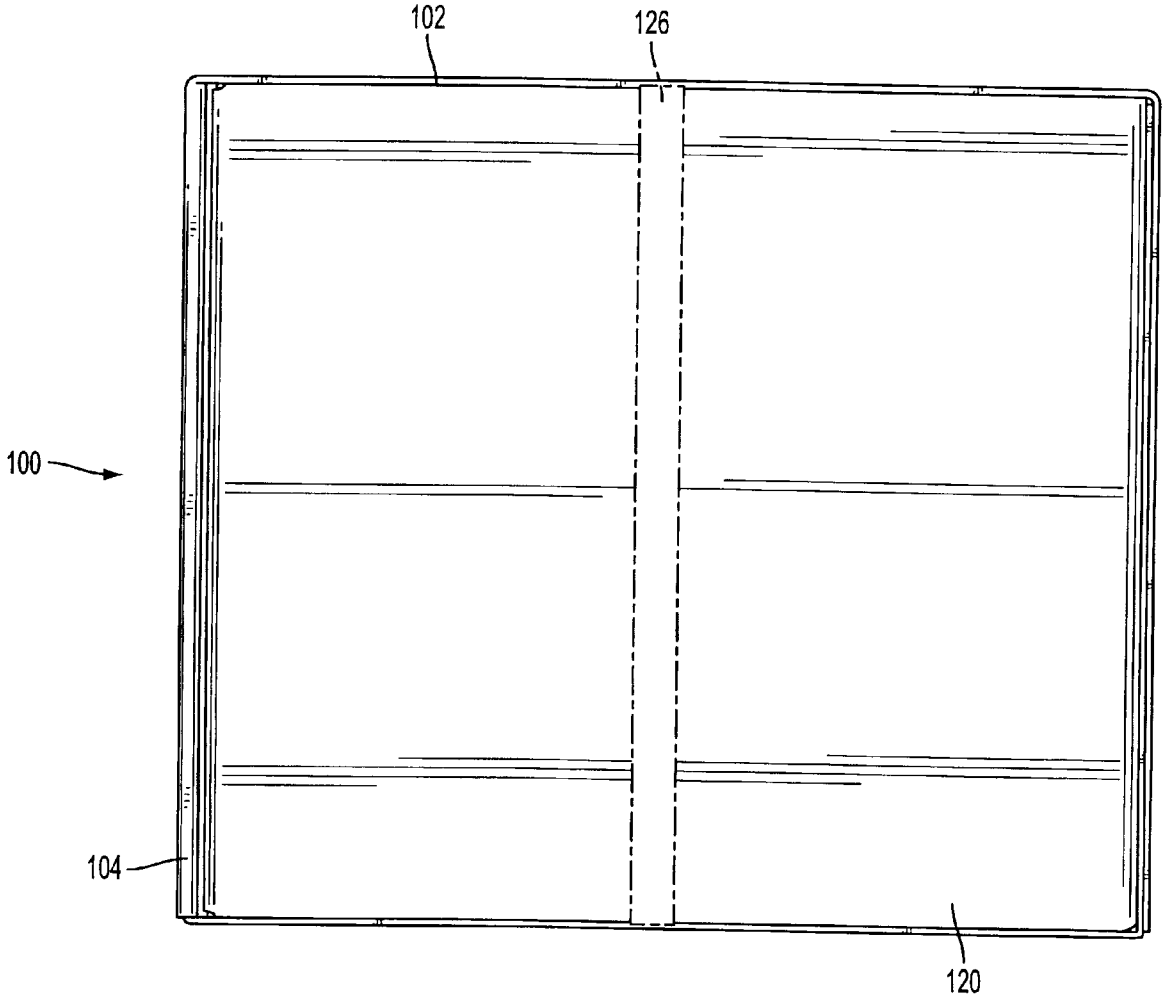
FIG. 3 is a bottom plan view of the multimedia distribution package shown in FIG. 1.
Figure 4:
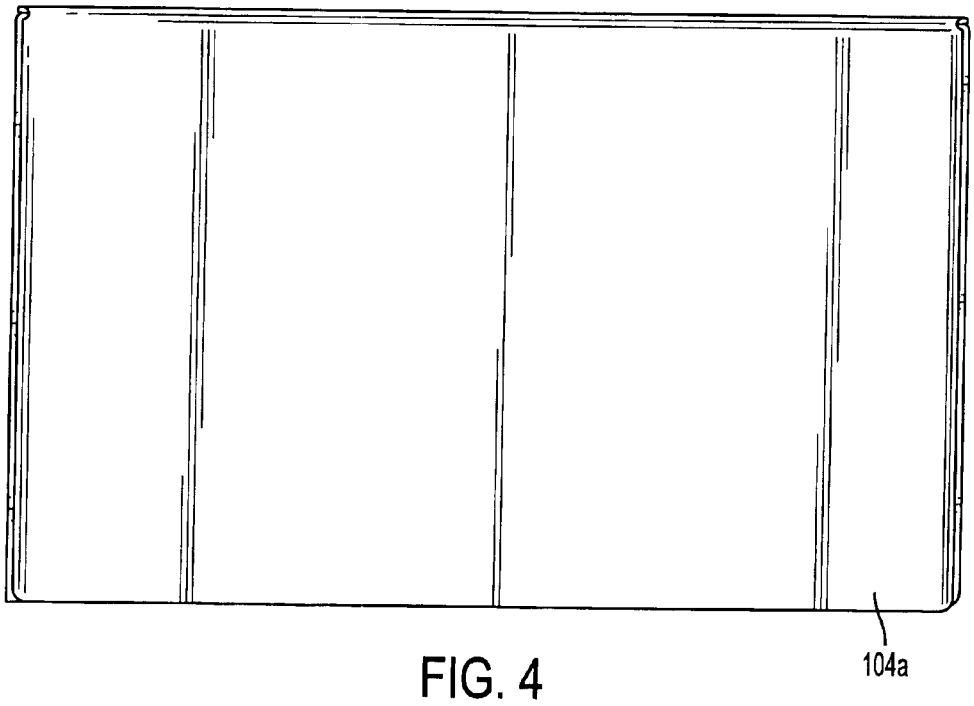
FIG. 4 is a right side elevation view of the multimedia distribution package shown in FIG. 1.
Figure 5:
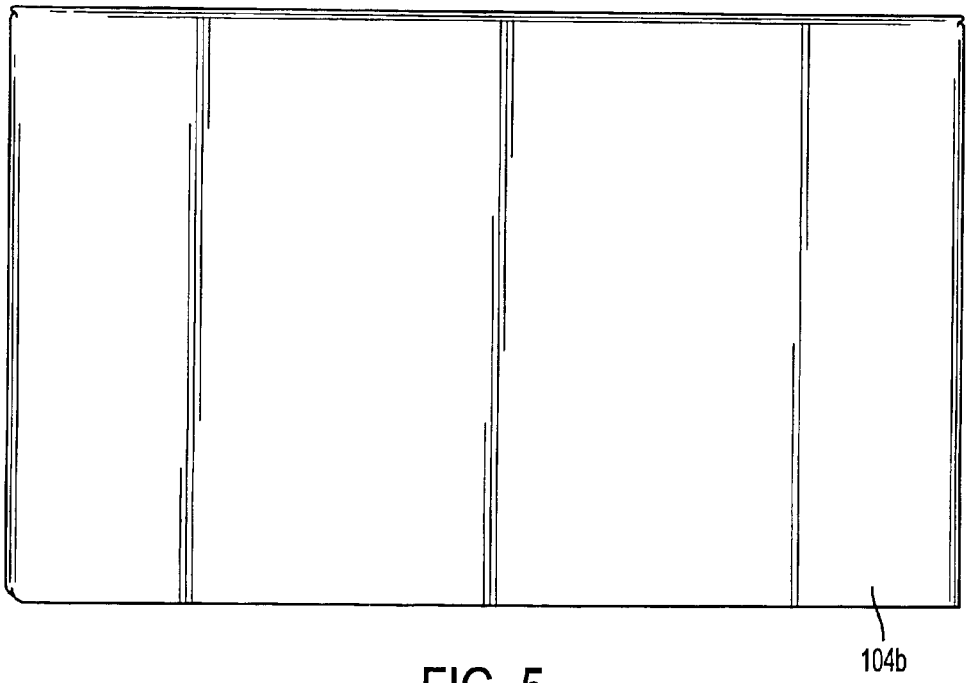
FIG. 5 is a left side elevation view of the multimedia distribution package shown in FIG. 1.
Figure 6:
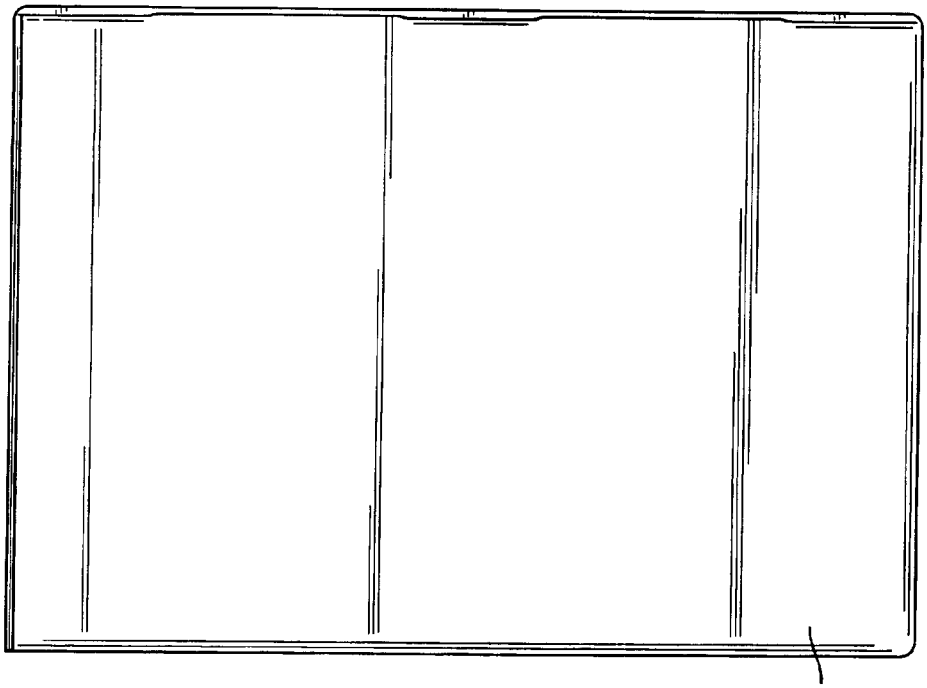
FIG. 6 is a front elevation view of the multimedia distribution package shown in FIG. 1.
Figure 7:
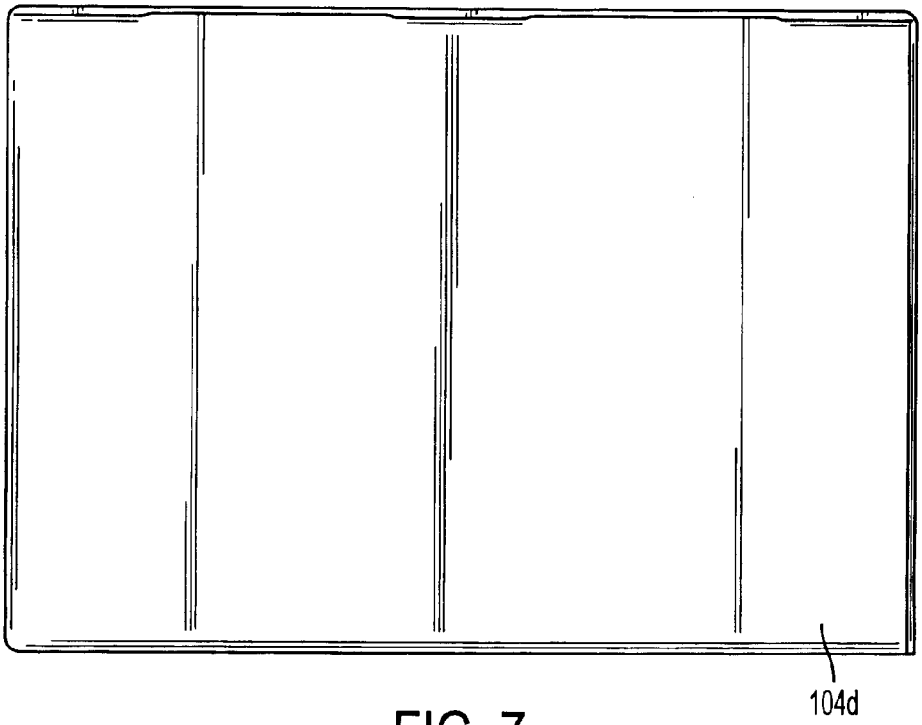
FIG. 7 is a back elevation view of the multimedia distribution package shown in FIG. 1.
Figure 8:
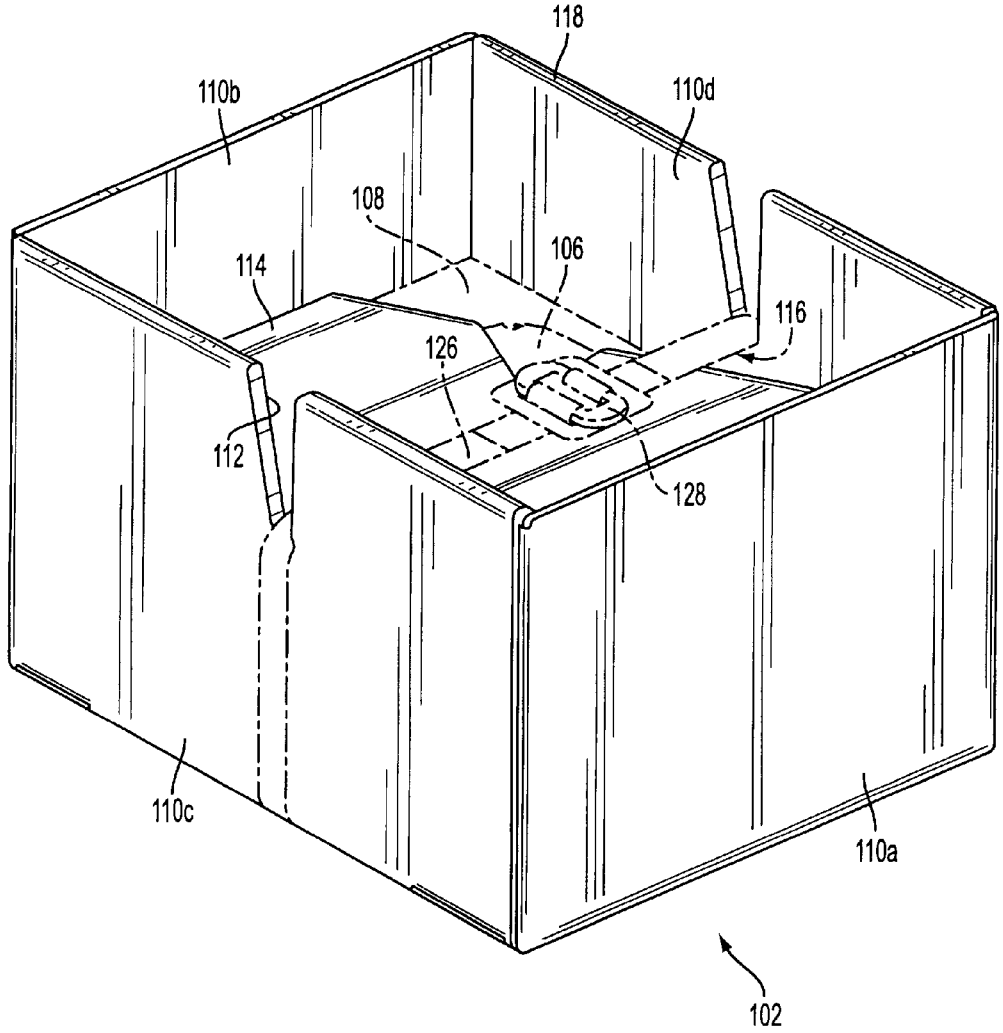
FIG. 8 is a perspective view of a bottom portion of the multimedia distribution package shown in FIG. 1, with a top portion of the multimedia distribution package having been removed to display the computer software and documentation held in place by a packaging insert.
Figure 9:
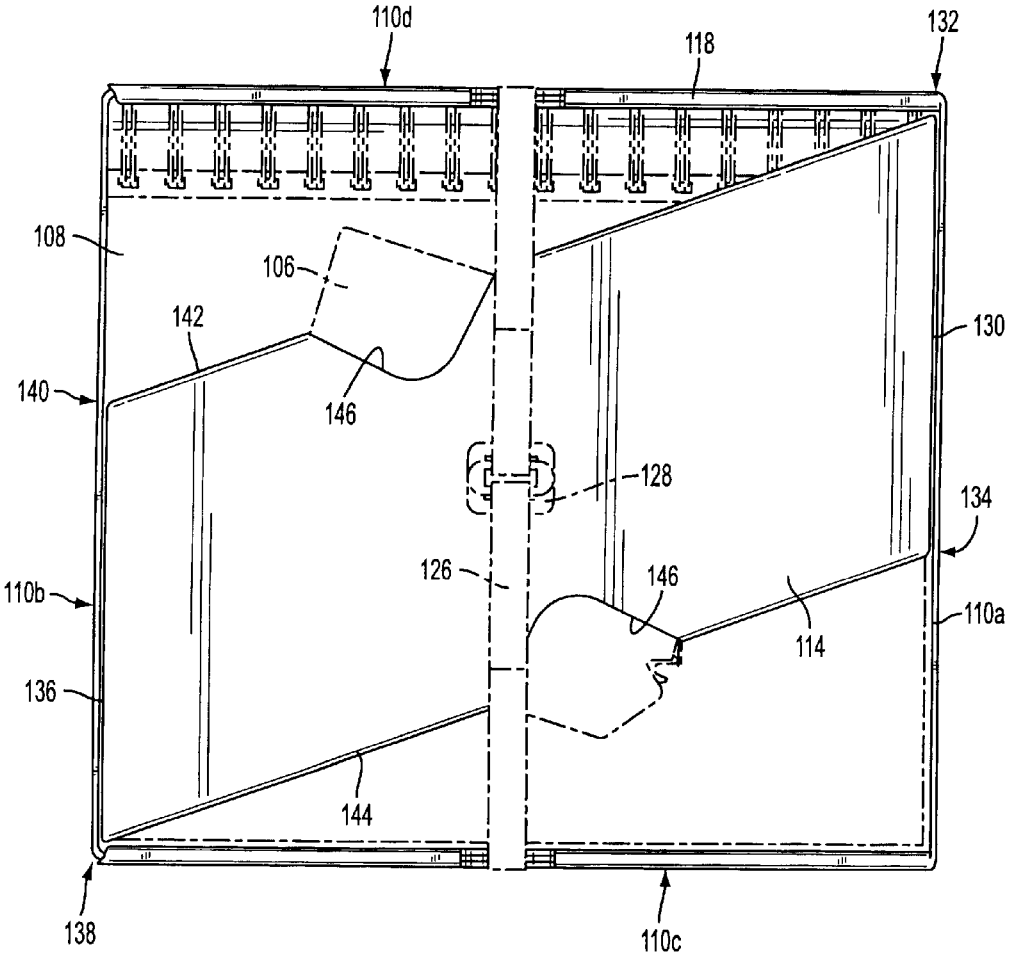
FIG. 9 is a top plan view of the multimedia distribution package shown in FIG. 8.
Figure 10:
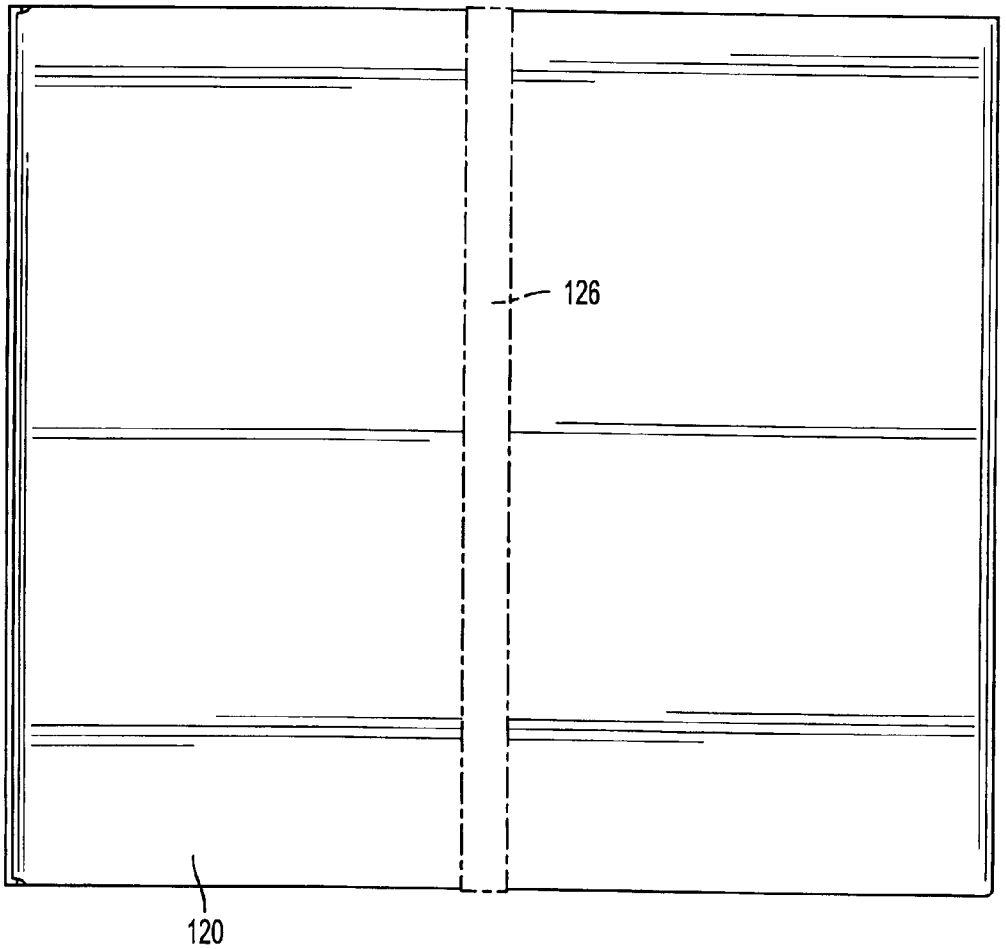
FIG. 10 is a bottom plan view of the multimedia distribution package shown in FIG. 8.
Figure 11:
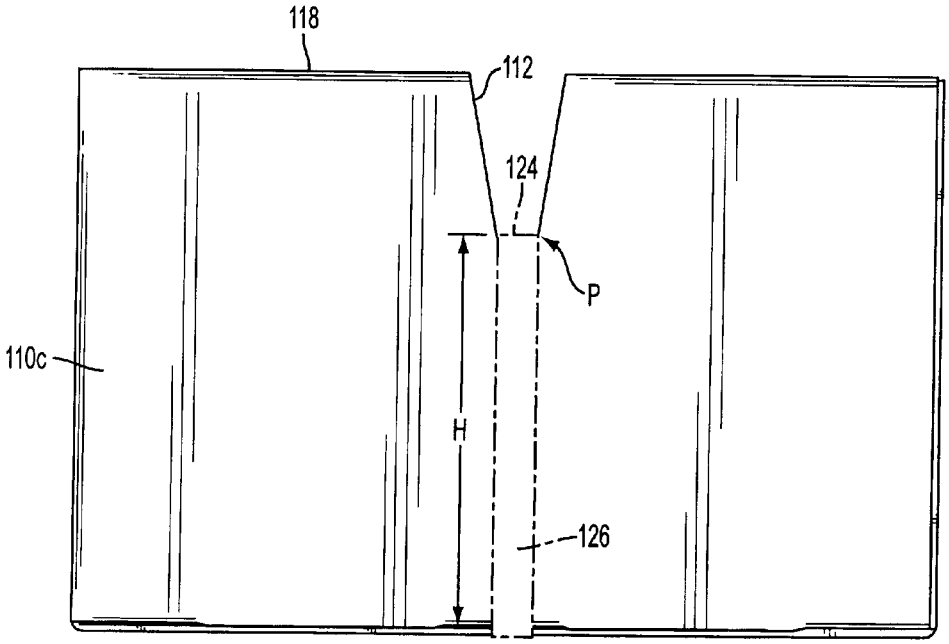
FIG. 11 is a right side elevation view of the multimedia distribution package shown in FIG. 8.
Figure 12:
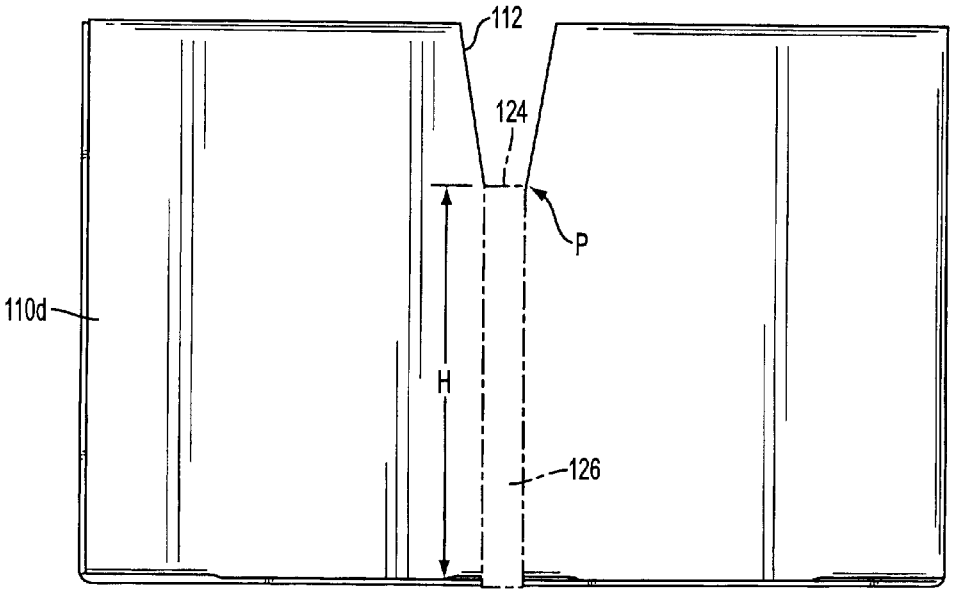
FIG. 12 is a left side elevation view of the multimedia distribution package shown in FIG. 8.
Figure 13:
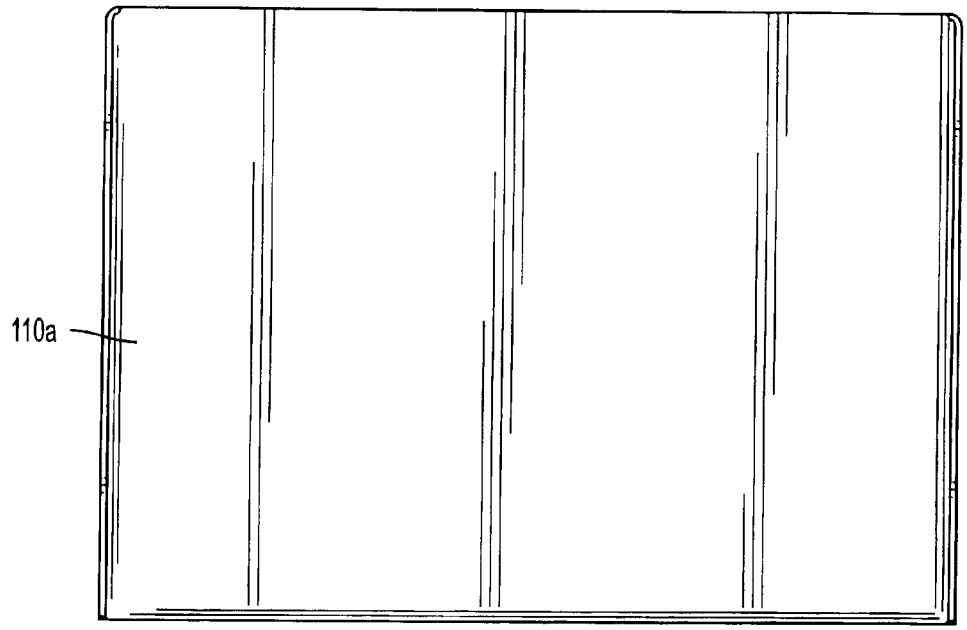
FIG. 13 is a front elevation view of the multimedia distribution package shown in FIG. 8.
Figure 14:
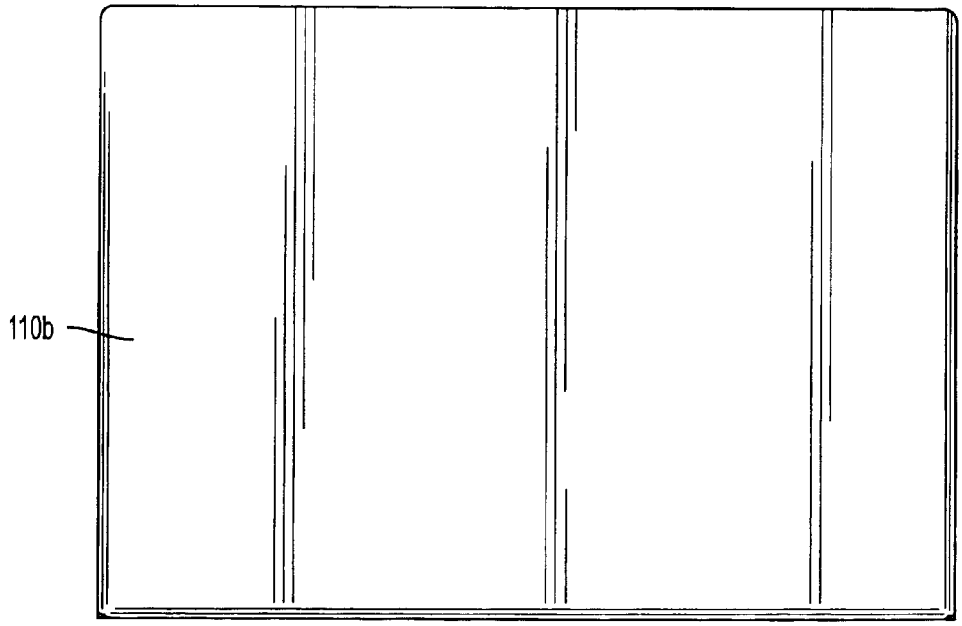
FIG. 14 is a back elevation view of the multimedia distribution package shown in FIG. 8.
Figure 15:
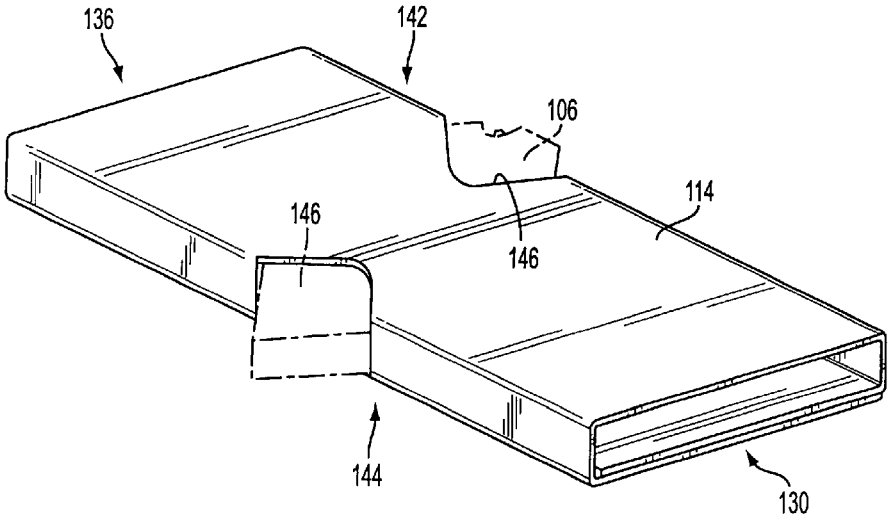
FIG. 15 is an enlarged perspective view of the packaging insert shown in FIGS. 8 and 9.
Figure 16:
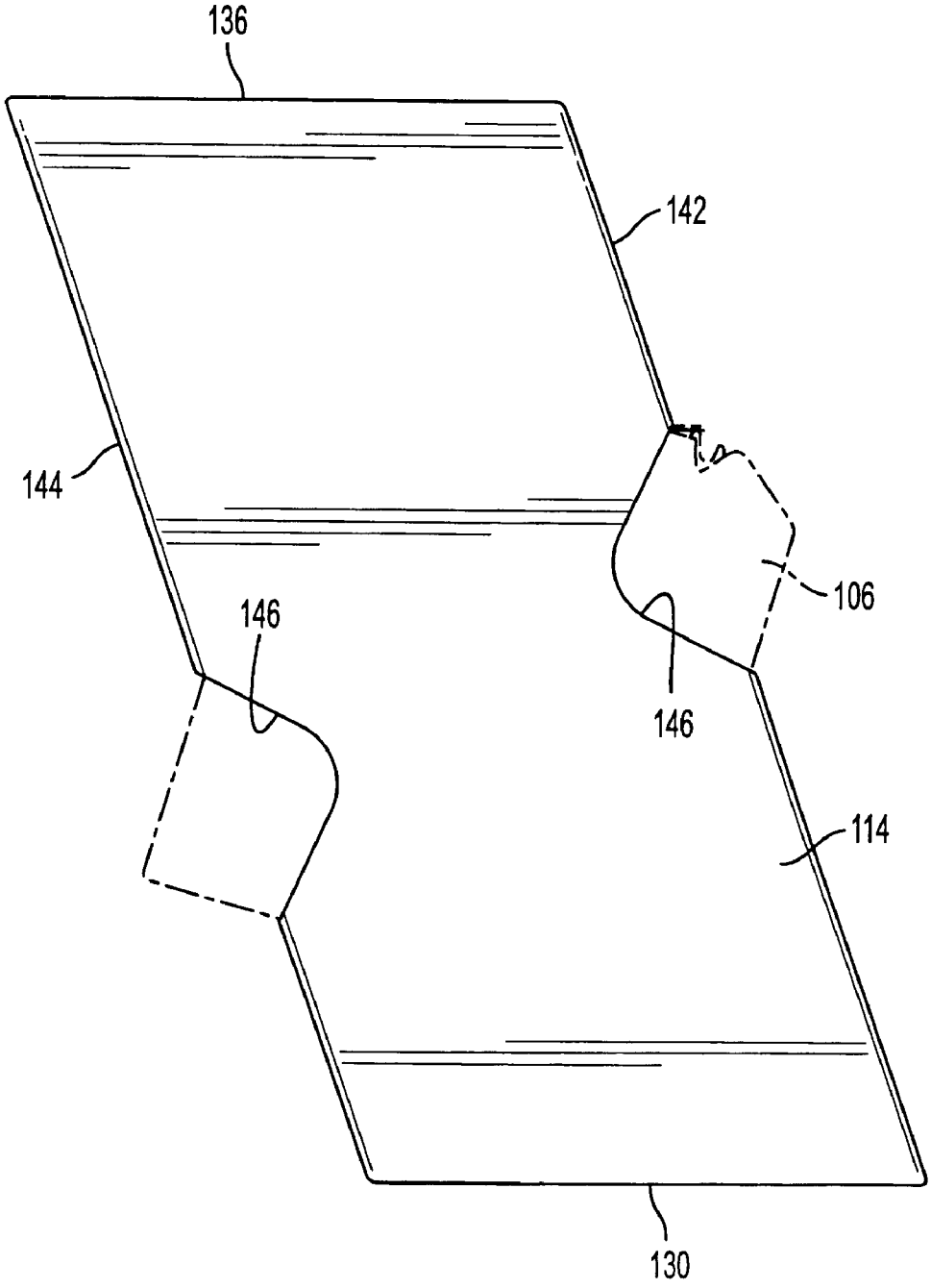
FIG. 16 is a top plan view of the packaging insert shown in FIG. 15.
Figure 17:
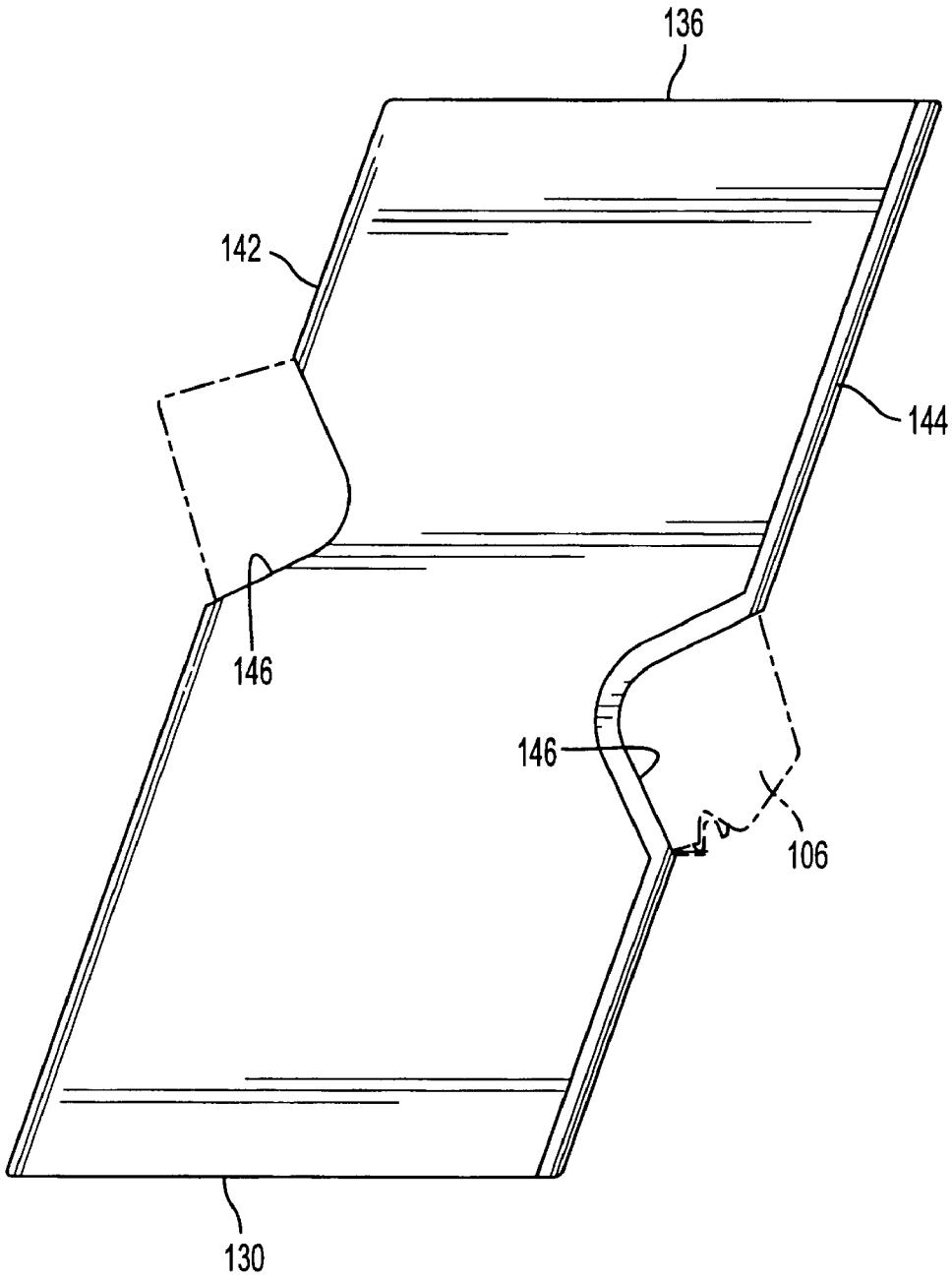
FIG. 17 is a bottom plan view of the packaging insert shown in FIG. 15.
Figure 18:
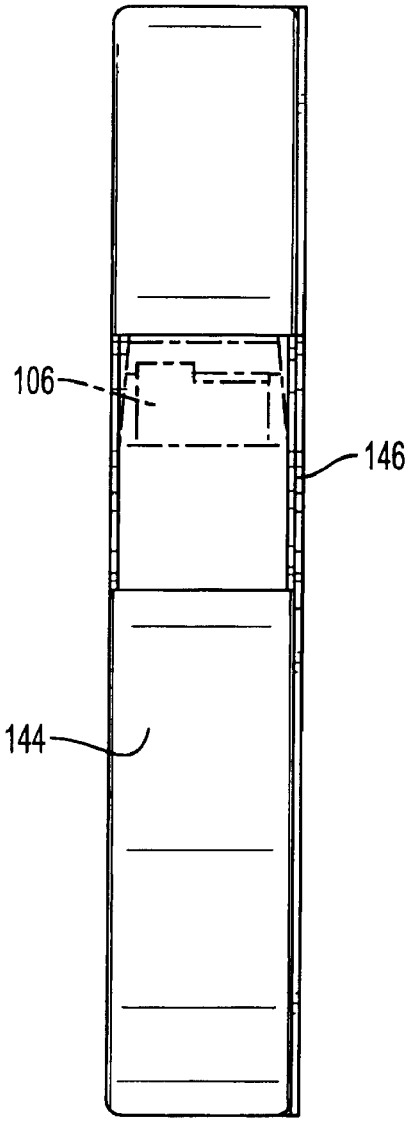
FIG. 18 is a right side elevation view of the packaging insert shown in FIG. 15.
Figure 19:
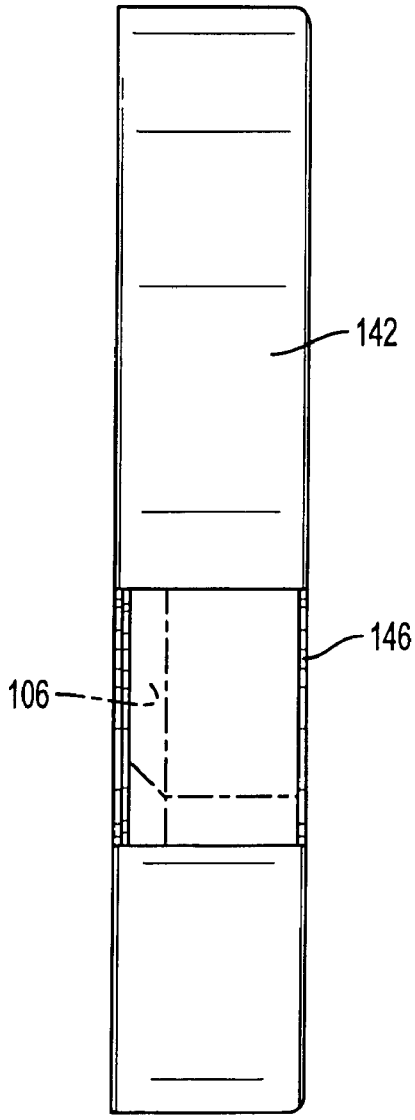
FIG. 19 is a left side elevation view of the packaging insert shown in FIG. 15.
Figure 21:
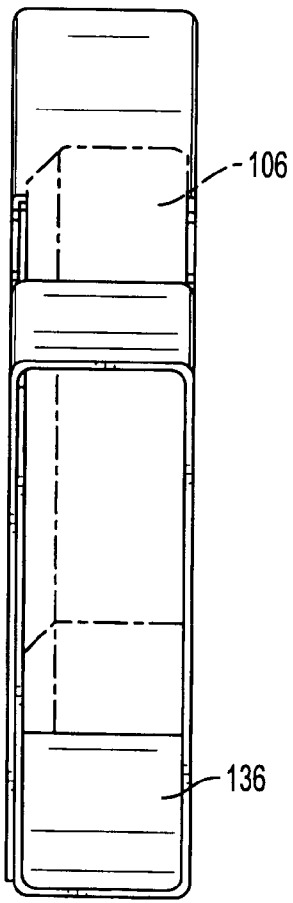
FIG. 21 is a back elevation view of the packaging insert shown in FIG. 15.
Figure 20:
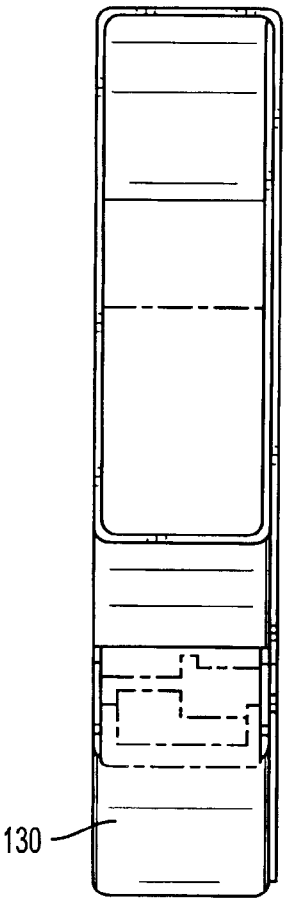
FIG. 20 is a front elevation view of the packaging insert shown in FIG. 15.

Referring now to the drawings, wherein like reference numerals and characters designate like or corresponding parts throughout the several views, there is shown in perspective view in FIG. 1 a multimedia distribution according to the present invention. The box 100 generally comprises a container portion 102 (FIGS. 3 and 8–12) and a lid portion 104 (FIGS. 2 and 4–7). Container portion 102 (see FIG. 8) is used to contain computer software 106 and documentation 108 that is associated with the software 106. It includes a plurality of upstanding walls 110*a*, 110*b*, 110*c*, 110*d*. The box 100 according to this embodiment is generally rectangular. However, it should be readily apparent to those of ordinary skill in the art that other shapes (e.g., circular, hexagonal, octagonal, etc.) could be used. At least two of the upstanding walls, however, must be opposing.

For example, in the box 100 according to the preferred embodiment, walls 110*c* and 110*d* are opposing. So too are walls 110*a* and 110*b*. Significantly, however, the opposing walls 110*c* and 110*d* provide a means to form a pair of slots 112, each of which is formed in a respective one of the opposing walls 110*c* and 110*d*.

The lid portion 104 (FIGS. 2 and 4–7) is adapted to cover container portion 102, and thereby enclose the software 106 and documentation 108 within an assembled box. Before assembly, an insert means 114 (FIG. 8, but shown in greater detail in FIGS. 15–21) is used to selectively position the software 106 within the container portion 102. Restraint means 116 (FIGS. 3 and 8–12), as will be described in greater detail herein below, is coupled through the slots 112 to maintain the insert means 114, the software 106, and the documentation 108 within the container portion 102. documentation throughout the length of the slots.

Referring again for the moment to FIG. 8, it can be seen that the container portion 102 has four generally upstanding walls including a front wall 110*a*, a back wall 110*b*, and two opposing side walls 110*c* and 110*d*. A rim 118 extends around the tops of the upstanding walls 110*a*, 110*b*, 110*c*, and 110*d*, and a bottom 120 joins those walls 110*a*, 110*b*, 110*c*, and 110*d*. The pair of slots 112 are formed in respective ones of the side walls 110*c* and 110*d*.

Each slot 112 generally comprises a substantially rectilinear relief in its respective side wall 110*c* and 110*d*. Such reliefs extend downwardly from the rim 118 of the side wall 110*c* and 110*d* to a preselected point 122 above the bottom 120. Preferably, the preselected point 122 generally comprises a height H above the bottom 120, which is sufficient to contain a minimum volume of the software 106, documentation 108, and any other training materials (e.g., video cassette recorder tapes) associated with the software 106.

In assembly, the documentation 108 and other training materials are first placed within the container 102, and the software 106 is placed within the insert 114 on top of the documentation 108 and other training materials. The insert 114 is adapted to position the software 106 appropriately and securely within the container 102. At a minimum, the assembled software 106 and insert 114, documentation 108, and other training material rises above the bottom 120 of the container 102 to the height H corresponding to the bottom 124 of each slot 112. The restraint means 116 is then wrapped around the container 102, within the slots 112, to secure the software 106, documentation 108, and other training materials in place. The lid 104 can then be positioned over the container 102 filled with the software 106, insert 114, and documentation 108, and the box 100 closed and fully assembled.

Virtually any appropriate restraint means 116 may be used, although an adjustable belt 126 (FIGS. 8 and 9) is preferred. The belt or band may comprise a rigid or flexible plastic (e.g., nylon, polyester, polypropylene, etc.), but a hand- or machine-grade polypropylene belt with a buckle 128 or metal joiner band (not shown) is preferred. One advantage of polypropylene belts is that they cost less, saving up to 70% over polyester or steel strapping. They also resist shock, elongating only 5% to 10%, to withstand stress and absorb severe shock. Moreover, if stretched they recover excellently to about 90% to 95% of their original length. They weigh less at only about 1/10 the weight of steel strapping for the same footage.

To accommodate such bands, the relief forming each slot 112 tapers downwardly from the rim of the side wall to a preselected point above the bottom, with the preselected point comprising a width substantially equal to the band. This helps secure the software 106 and documentation 108 in place. A second means of securing such software 106 and documentation 108 is provided by the preselected shape of the insert 114. That is, the restraint means 116 effectively keeps the software 106 and documentation 108 in place, and prevents movement in a relative up and down direction. By virtue of careful selection of the shape of the insert 114, however, relative side-to-side or lateral movement is prevented in accordance with the present invention.

The insert 114 preferably comprises a shape that extends the entire length of the container 102 between the front wall 110*a* and the back wall 110*b*. According to one presently preferred embodiment, that shape comprises a parallelogram. In the manner, and referring now to FIG. 9 in conjunction with FIGS. 15–21 the parallelogram-shaped insert 114 includes a front portion 130 that extends from a first corner 132 of the container 102 formed by the front wall 110*a* and one of the side walls 110*d* to a first point 134 along the front wall 110*a*, a back portion 136 that extends from a second corner 138 of the container 102 formed by the back wall 110*b* and the other of the side walls 110*c* to a second point 140 along the back wall 110*b*, a first side portion 142 that extends between the first corner 132 to the second point 140, and a second side portion 144 that extends between the second corner 138 and the first point 134. This corner-to-corner arrangement, thus, effectively keeps the software 106 from moving laterally.

According to another important aspect of the present invention, the shape includes a pocket 146 formed to hold the software 106 in place. Pocket 146 is sized so as to hold the software 106 in place within the insert 114, yet at the same time provide visible access to the software 106. For any particular media in which the software 106 is stored, additional inserts 114 may be included.

Any suitable material may be used in making box 100. However, in accordance with one presently preferred embodiment, the container 102, the insert 114, and the lid 104 each comprise a paperboard product.

While this invention has been particularly shown and described with reference to a preferred embodiment thereof, it will be understood by those skilled in the art that various changes in form and detail may be made therein without departing from the spirit and scope of this invention.

What is claimed is:

1. A multimedia distribution box, comprising:

a container portion for containing computer software and documentation associated with said software, said container portion including a plurality of upstanding walls, at least two of which are opposing, and a pair of slots, each of which is formed in a respective one of said opposing walls;

a lid portion adapted to cover said container portion, thereby enclosing said software and said documentation within an assembled box; and insert means for selectively positioning said software within said container portion; and restraint means, coupled through said slots, for maintaining said insert means, said software, and said documentation within said container portion.

2. The box according to claim 1, wherein said slots are substantially rectilinear.

3. The box according to claim 2, wherein said slots are tapered.

4. The box according to claim 1, wherein said restraint means comprises a belt.

5. The box according to claim 4, wherein said belt is adjustable.

6. The box according to claim 4, wherein said belt comprises a continuous plastic band looped around said container portion and within said slots.

7. The box according to claim 4, wherein said belt comprises an adjustable plastic band looped around said container portion and within said slots.

8. The box according to claim 4, wherein said belt comprises a flexible band.

9. The box according to claim 8, wherein said flexible band is adapted to provide a substantially uniform amount of pressure to restrain said insert means, said software, and said documentation throughout the length of said slots.

10. The box according to claim 1, wherein said cover portion substantially covers said upstanding walls.

11. A box for shipping and displaying computer software, documentation and any other training materials associated with the software, comprising:

a container having four generally upstanding walls including a front wall, a back wall, and two side walls, a rim extending around the tops of said upstanding walls, and a bottom;

a pair of slots, each said slot being formed in a respective one of said side walls;

an insert adapted to position the software within said container;

a band wrapped around said container within said slots; and a lid having four generally upstanding walls adapted to substantially cover said front wall, said back wall, and said side walls when the box is assembled.

12. The box according to claim 11, wherein each said slot comprises a substantially rectilinear relief in its respective side wall.

13. The box according to claim 12, wherein said relief extends downwardly from said rim of said side wall to a preselected point above said bottom.

14. The box according to claim 13, wherein said preselected point comprises a height above said bottom sufficient to contain a minimum volume of the software, documentation, and other training materials associated with the software.

15. The box according to claim 12, wherein said relief tapers downwardly from said rim of said side wall to a preselected point above said bottom, with said preselected point comprising a width substantially equal to said band.

16. The box according to claim 11, wherein said insert comprises a shape extending the entire length of said container between said front wall and said back wall.

17. The box according to claim 16, wherein said shape comprises a parallelogram.

18. The box according to claim 17, wherein said parallelogram comprises a front portion that extends from a first comer of said container formed by said front wall and one of said side walls to a first point along said front wall, a back portion that extends from a second comer of said container formed by said back wall and the other of said side walls to a second point along said back wall, a first side portion that extends between said first comer to said second point, and a second side portion that extends between said second comer and said first point.

19. The box according to claim 16, wherein said shape includes a pocket formed therein to hold the software in place.

20. The box according to claim 11, wherein said container, said insert, and said lid each comprise a paperboard product.

* * * * *